US008021450B2

(12) United States Patent
Sinram et al.

(10) Patent No.: US 8,021,450 B2
(45) Date of Patent: Sep. 20, 2011

(54) ABRASIVE WHEELS AND PRODUCTION THEREOF

(75) Inventors: Diethard Sinram, Spenge (DE); Peter Alfer, Melle (DE)

(73) Assignee: Rud, Stark GmbH & Co., KG, Melle (DE)

( * ) Notice: Subject to any disclaimer, the term of this patent is extended or adjusted under 35 U.S.C. 154(b) by 846 days.

(21) Appl. No.: 11/660,769

(22) PCT Filed: Jan. 3, 2006

(86) PCT No.: PCT/EP2006/050023

§ 371 (c)(1), (2), (4) Date: Aug. 14, 2007

(87) PCT Pub. No.: WO2006/087247

PCT Pub. Date: Aug. 24, 2006

(65) Prior Publication Data

US 2008/0064312 A1 Mar. 13, 2008

(30) Foreign Application Priority Data

Feb. 19, 2005 (DE) ..... 10 2005 007 661

(51) Int. Cl.
*B24B 1/00* (2006.01)
*B24B 55/04* (2006.01)
*B24D 11/00* (2006.01)

(52) U.S. Cl. ..... 51/295; 451/540

(58) Field of Classification Search ..... 451/540; 51/295

See application file for complete search history.

(56) References Cited

U.S. PATENT DOCUMENTS 4,486,200 A * 12/1984 Heyer et al. ..... 51/295

FOREIGN PATENT DOCUMENTS

| | | |
|---|---|---|
| DE | 26 08 273 | 9/1977 |
| DE | 29 21 341 C2 | 12/1979 |
| GB | 2 021 626 A | 12/1979 |
| WO | WO 01/85393 A1 | 11/2001 |

* cited by examiner

*Primary Examiner* — Anthony J Green
*Assistant Examiner* — Pegah Parvini
(74) *Attorney, Agent, or Firm* — Barnes & Thornburg LLP

(57) ABSTRACT

An abrasive device for a grinding tool. The abrasive device includes abrasive grains material-lockingly connected with one another by a bonding agent. The abrasive grains have an approximately spherical contour. The abrasive device further includes a porosity of at least 35 percent. The present disclosure also relates to a method for producing the abrasive device.

12 Claims, 1 Drawing Sheet

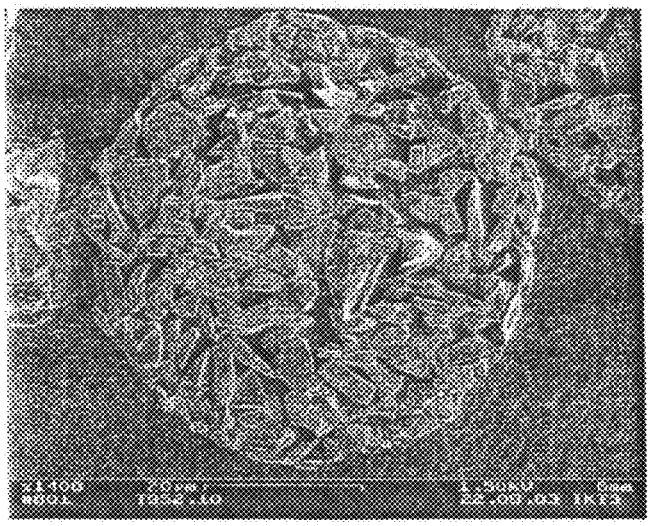
Fig. 1 Homogeneous Distribution of the Abrasive Grains
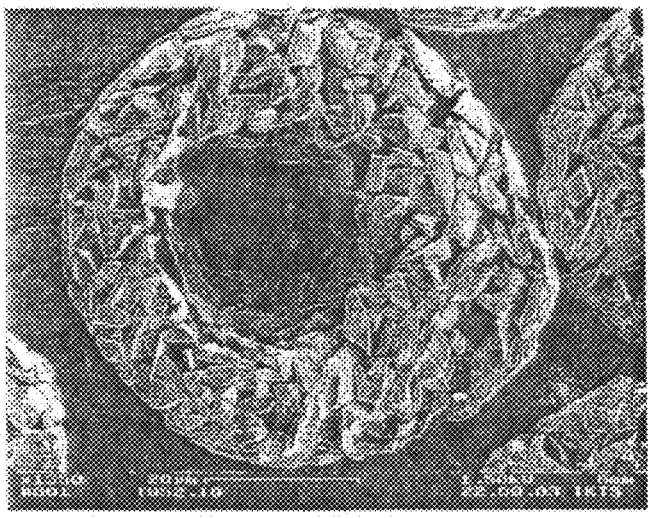
Fig. 2 Inhomogeneous Distribution of the Abrasive Grains
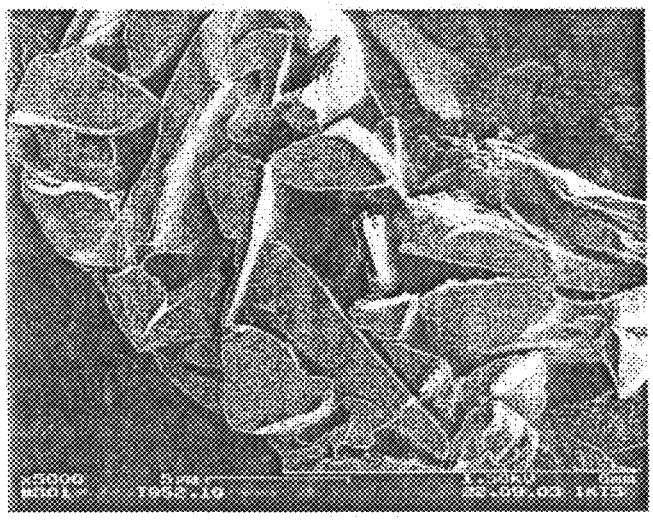
Fig. 3 Representation of the Bonding of the Abrasive Grains

ABRASIVE WHEELS AND PRODUCTION THEREOF

BACKGROUND AND SUMMARY

The present disclosure relates to abrasive wheels or abrasive devices, and more particularly to grinding tools. This particularly involves grinding tools where the abrasive wheels or devices are material-lockingly fixed on a carrier. The carriers may be flexible, and the respective grinding tools may be constructed, for example, in the shape of bands or pads.

Thus, from German Patent Document DE 26 08 273 A, a sheet-shaped or a band-shaped grinding tool is known as well as a method and a device for producing such grinding tools. In addition, it is pointed out that, in the case of such grinding tools, abrasive devices of a spherical shape are to be used which are interspersed with organic bonding agents along the entire diameter.

The production of such abrasive devices is to take place according to this known teaching in that, from a suspension made of abrasive grains and of an organic bonding agent matrix, spherical abrasive devices are formed within the suspension in a stirrer vessel from a plurality of abrasive grains and, in the process, are suspended by the stirring. In this case, the drop-shaped abrasive devices formed of a plurality of abrasive grains are bound in the suspension by the bonding agent. After the spherical abrasive devices have reached a sufficient firmness in the suspension, these are to be separated from the liquid constituents, for example, by decanting or other processes.

Subsequently, the spherical abrasive devices can be cleaned on the outside by a solvent and can then be dried. They will then be available for the production of grinding tools.

By introducing air or a blowing agent into the suspension, a slight porosity can be set at the spherical drops forming the abrasive devices. In each case, the porosity should form less than 35% closed pores, in which case a range of from 7 to 15% of the volume should be constructed as closed pores.

In the case of the teaching described in German Patent Document DE 26 08 273 A, abrasive devices can therefore be obtained which have an outside diameter potential considerably restricted in the downward direction. In addition, the thus obtained abrasive devices can also only be produced from relatively large abrasive grain fractions. Thus, explicitly, 200 μm are indicated as the smallest outside diameter for abrasive devices and 3 μm are indicated as the smallest median grain size of the abrasive grains.

However, by such grinding tools, which were produced with corresponding abrasive devices, a very fine grinding surface treatment on diverse workpieces cannot be carried out. Such a surface treatment is desirable particularly when machining or finishing decorative paint layers and particularly in the construction of vehicles.

In addition, the service life of such grinding tools is limited.

The present disclosure relates to abrasive devices of a grinding tool which are suitable for a very fine grinding machining of surfaces of workpieces.

According to the present disclosure, an abrasive device comprises abrasive grains material-lockingly connected with one another by a bonding agent. The abrasive grains include an approximately spherical contour. The bonding agent includes a synthetic resin. The synthetic resin includes at least one of a) phenolic resin, b) polyurethane, c) epoxy resin, and d) polyvinyl butyral. The abrasive device further comprises a porosity of at least 35 percent. Such an abrasive device can be produced by a method comprising the steps of: forming small drops from a suspension including a bonding agent, a solvent and abrasive grains, the bonding agent including a synthetic resin, the synthetic resin including at least one of a) phenolic resin, b) polyurethane, c) epoxy resin, and d) polyvinyl butyral; expelling the solvent from the drops; activating the bonding agent by at least one heat treatment to establish material-locking connections of adjacent abrasive grains obtained from a single drop. The abrasive device includes a porosity of at least 35 percent.

Abrasive devices for grinding tools according to the present disclosure are thus formed from abrasive grains mutually material-lockingly connected by a bonding agent. The abrasive devices have an at least approximately spherical outer contour and a porosity of at least 35%. A porosity of above 40% can also be achieved and maintained.

The abrasive devices may be formed of abrasive grains whose particle size is in the range of between 0.05 and 10 μm, and also between 0.1 to 3 μm.

By such small abrasive grains, abrasive devices can then be provided whose outside diameter is in the range of between 10 and 150 μm, and also between 25 and 80 μm.

For a use on grinding tools, a production or a separation can take place such that a narrowly restricted outside diameter range, virtually a constant graining of the abrasive devices, was maintained for the individual abrasive devices.

For the abrasive devices according to the present disclosure, a deviation of maximally 20% about an average value for the particle size of the abrasive grains used for an abrasive device should be maintained for a definable particle size.

The abrasive devices according to the present disclosure include a ball-shaped/spherical outer contour. Such abrasive devices can be used for grinding tools in which a homogeneous distribution of abrasive grains material-lockingly connected by a bonding agent was maintained. As a result, the porosity is almost constant over the entire volume of an abrasive device.

In an embodiment of the present disclosure, the abrasive devices constructed with a spherical outer contour may also be completely hollow on the inside and form a correspondingly porous shell around a cavity of mutually material-lockingly connected abrasive grains. In this case, a porosity of at least 35% can then also be maintained in the shell.

The binding agent used for the material-locking connection of abrasive grains should have ≦10% by mass in the case of a respective abrasive device. In such a case, bonding agent fractions of ≦5% by mass may also be sufficient.

The abrasive grains can be selected from SiC, $Al_2O_3$(corundum), BN, WC/CO, WC, diamond, zircon corundum, SG grain (abrasive grains as a result of the sol-gel or sintering process). Mixtures of these chemical compounds are usable for the production of the abrasive devices.

For example, different phenolic resins, polyurethane, epoxy resins, urea resins and PVB (polyvinyl butyral) can be used as bonding agents.

A plurality of abrasive devices can then be material-lockingly fixed on a carrier such as on band-shaped or sheet-shaped carriers. The material-locking fixing can be used also with a bonding agent, such as an organic bonding agent, which may be the same bonding agent by which the abrasive grains are also material-lockingly connected to form an abrasive device.

The abrasive devices may be fixed in the form of a single layer of an equidistant arrangement, which is as uniform as possible, on at least one surface of a carrier. However, it is also conceivable to fix abrasive devices in several layers on a carrier, or to apply abrasive devices as a heterogeneous bulk onto the carrier and fix them again in a material-locking manner.

In another embodiment of the present disclosure, abrasive devices having at least approximately constant outside diameters may be mounted and fixed on a carrier for a grinding tool.

After their actual production, abrasive devices can be tempered again. This may take place in a temperature range of between 150 and 200° C., possibly at approximately 175° C. for a period of two hours.

However, such a tempering may also be carried out simultaneously with the material-locking fixing of the abrasive devices on the respective carrier together with the establishment of the material-locking fixing.

A UV curing of the abrasive devices after their actual production as well as a cold setting by suitable bonding agent systems is also conceivable.

The abrasive devices according to the present disclosure may be produced by a suspension formed of a bonding agent, of a solvent and of abrasive grains, in which suspension, as required, other additives may also be included.

In contrast to the state of the art, small drops, or agglomerates, are formed from and not in the suspension, from which the solvent is expelled after the drop formation, for example, by evaporation.

By a heat treatment, which can also be carried out additionally to the expelling of the solvent, the actual forming of the abrasive devices then takes place with the establishment of material-locking connections of respectively adjacent abrasive grains by a corresponding activation of the used bonding agent.

The drops, as mentioned above, should not be formed within the suspension but in a gas atmosphere, such as air or nitrogen.

This can be achieved, for example, by the spray drying, freeze drying or spray-freeze drying methods that are known.

However, other production possibilities are also conceivable, in which correspondingly small drops emerge from a suspension received in a receptacle into a gas atmosphere. Subsequently, as mentioned above, the solvent can be expelled and the material-locking joining of the abrasive grains of a drop can be carried out by a corresponding activation of the used bonding agent for the final formation of an abrasive device. As a result of the special spherical alignment of the individual abrasive grains on the surface of the forming abrasive devices, a high initial surface roughness is avoided.

The grinding tools constructed with the abrasive devices according to the present disclosure can now be used for a high-precision processing of workpiece surfaces, which, as noted herein, were provided with additional protective layers, such as paint coats. In such a case, resulting small outside diameters have an advantageous effect in connection with the small particle sizes of the abrasive grains used for the production of abrasive devices.

As a result of the relatively high porosity, which can be set to up to 70%, an extended usage duration of the grinding tools produced with the abrasive devices according to the present disclosure can also be achieved. That is because the correspondingly available open pore volume can absorb a relatively considerably greater abrasion fraction than in the case of the solutions known from the state of the art.

Generally, the individual abrasive grains of the individual abrasive devices are not wetted by the bonding agent over an entire surface at their respective surfaces. Therefore, for the material-locking joining of the individual adjacent abrasive grains, only small surface areas were wetted by the bonding agent, by which, in turn, the material-locking joining of the adjacent abrasive grains was established at the abrasive devices. Individual abrasive grains may become detached when the grinding tools are used and again expose free pores for a further absorption of abrasion during the grinding.

Other aspects of the present disclosure will become apparent from the following descriptions when considered in conjunction with the accompanying drawings.

BRIEF DESCRIPTION OF THE DRAWINGS

FIG. 1 is FESEM photo of an abrasive device, according to the present disclosure, shown as a 1,400:1 enlargement.

FIG. 2 is a FESEM photo of an internally hollow abrasive device, according to the present disclosure, shown as a 1,350:1 enlargement.

FIG. 3 is a cutout of a FESEM photo of a partial area of an abrasive device, according to the present disclosure, shown as a 5,000:1 enlargement.

DETAILED DESCRIPTION

Before the FESEM photos shown in FIGS. 1 to 3 were taken, a preparation took place which permitted the imaging of the inner structure of the abrasive devices in a faultless manner.

In addition, FIGS. 1 to 3 demonstrate that the individual abrasive devices were produced with a correspondingly increased porosity which can be held at least above 35%, at least at 40% and, also at approximately 70%.

FIG. 2 illustrates that an internally hollow abrasive devices can be produced.

For the production of the abrasive devices illustrated in FIGS. 1 to 3, abrasive grains made of SiC with a particle size of approximately 5 μm are used. The correspondingly produced abrasive devices include an approximately spherical contour with outside diameters of approximately 50 μm. In some cases, a grading to this diameter range of approximately 50 μm was carried out after the production of the abrasive devices.

For the production of the abrasive devices, suspensions with different bonding agents and also different solvents were prepared.

Thus, an aqueous suspension was prepared with a polyurethane bonding agent which is present in the suspension with a fraction of 2 to 4 percent by mass and the indicated abrasive SiC grains. In this case, the fraction of SiC in the suspension amounted to 40-70 percent by mass.

Instead of a polyurethane bonding agent, however, a phenolic resin, such as novolac, could be used as the bonding agent with fractions of 2 to 4 percent by mass for the production of the suspension, in which case acetone was added to the suspension as the solvent.

By spray drying using a two-constituent nozzle, abrasive devices were formed from this suspension from the droplets of the suspension formed in the process. In this case, the solvent, such as water or acetone, was first expelled, and the respective bonding agent was correspondingly activated for forming the material-locking connection between adjacent abrasive grains for the individual abrasive devices. A temperature in the range of from 250 to 120° C. was maintained for the corresponding drying/activating.

Subsequently, the abrasive devices were tempered again at a temperature of approximately 175° C. for approximately two hours for increasing their overall stability.

The abrasive devices then had a porosity in the range of between 60 and 70% and subsequently, as noted above, could be fixed in a material-locking manner on a corresponding carrier for the production of grinding tools.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. An abrasive device for a grinding tool, the abrasive device consisting essentially of:

abrasive grains material-lockingly connected with one another by a bonding agent and having approximately a spherical contour;

the bonding agent including only a synthetic resin, the synthetic resin including at least one of a) phenolic resin, b) polyurethane, c) epoxy resin, and d) polyvinyl butyral;

the abrasive device possessing a porosity of at least 35 percent; and wherein the abrasive device is material-lockingly fixed on a carrier.

2. The abrasive device according to claim 1, wherein the abrasive grains include a particle size of 0.05 to 10 μm.

3. The abrasive device according to claim 1, wherein the abrasive grains include a particle size of 0.1 to 3 μm.

4. The abrasive device according to claim 1, wherein an outside diameter of the abrasive device is 10 to 150 μm.

5. The abrasive device according to claim 1, wherein an outside diameter of the abrasive device is 25 to 80 μm.

6. The abrasive device according to claim 1, wherein a maximal deviation of a particle size of 20 percent is maintained for the abrasive grains.

7. The abrasive device according to claim 1, further wherein the porosity of at least 35% is homogeneously distributed in the abrasive device.

8. The abrasive device according to claim 1, wherein an interior of the abrasive device is hollow.

9. The abrasive device according to claim 1, wherein the bonding agent is less than or equal to 5% by mass of the abrasive device.

10. The abrasive device according to claim 1, wherein the abrasive grains are selected from a group consisting of SiC, $Al_2O_3$(corundum), BN, WC/Co, WC, diamond, zircon corundum, SG grain, which SG grain is as a result of a sol-gel or sintering process.

11. The abrasive device according to claim 1, wherein the bonding agent is treated by one of UV curing, temperature-related hardening and cold setting.

12. An abrasive device for a grinding tool, the abrasive device consisting essentially of:

abrasive grains material-lockingly connected with one another by a bonding agent and having approximately a spherical contour;

the bonding agent including only a synthetic resin, the synthetic resin including at least one of a) phenolic resin, b) polyurethane, c) epoxy resin, and d) polyvinyl butyral;

the abrasive device possessing a porosity of at least 35 percent; and wherein the bonding agent is less than or equal to 5% by mass of the abrasive device.

* * * * *